US006945430B2

(12) United States Patent
Bloc

(10) Patent No.: US 6,945,430 B2
(45) Date of Patent: Sep. 20, 2005

(54) DEVICE FOR SELECTIVELY DISPENSING TWO PRODUCTS

(75) Inventor: Richard Bloc, Crosvilee-sur-Scie (FR)

(73) Assignee: Rexam Dispensing Systems, Le Treport (FR)

( * ) Notice: Subject to any disclaimer, the term of this patent is extended or adjusted under 35 U.S.C. 154(b) by 254 days.

(21) Appl. No.: 10/363,252

(22) PCT Filed: Sep. 6, 2001

(86) PCT No.: PCT/FR01/02767

§ 371 (c)(1),
(2), (4) Date: Jul. 11, 2003

(87) PCT Pub. No.: WO02/20169

PCT Pub. Date: Mar. 14, 2002

(65) Prior Publication Data

US 2004/0238567 A1 Dec. 2, 2004

(30) Foreign Application Priority Data

Sep. 8, 2000 (FR) ..... 00 11468

(51) Int. Cl.[7] ..... B67D 5/52
(52) U.S. Cl. ..... 222/135; 222/144.5; 222/321.9

(58) Field of Search ..... 222/135, 137, 222/144.5, 321.9

(56) References Cited

U.S. PATENT DOCUMENTS 4,006,841 A * 2/1977 Alticosalian ..... 222/144.5
5,411,176 A * 5/1995 Favre ..... 222/144.5
5,967,372 A * 10/1999 Favre ..... 222/321.9

FOREIGN PATENT DOCUMENTS

FR 2733800 A1 * 11/1996 ..... F04B/9/14

* cited by examiner

*Primary Examiner*—Philippe Derakshani
(74) *Attorney, Agent, or Firm*—Bacon & Thomas

(57) ABSTRACT

The invention relates to a device for selectively dispensing liquids from a plurality of independent reservoirs (R), each of which is equipped with a drawing-off member (P) provided with a dispensing head (T) suitable for being actuated by being pressed axially, said device being characterized in that it comprises a single push-button (1) whose bottom face **(1*a*) is provided with a series of axial bushes (10) suitable for engaging simultaneously and removably over one or more dispensing heads (T) by means of said push-button (1) being turned and angularly keyed on a central bearing (2)** secured to the reservoirs (R).

7 Claims, 2 Drawing Sheets

DEVICE FOR SELECTIVELY DISPENSING TWO PRODUCTS

The present invention relates to a device for selectively dispensing different liquids.

More precisely, the invention relates to selectively dispensing different liquids, separately or jointly, from a single packaging unit having a plurality of independent reservoirs.

Known dispensers generally comprise a reservoir equipped, in particular, with a drawing-off member of the pump or valve type for drawing off the liquid, which member is provided with a spray head suitable for being actuated by being pressed axially by hand.

Devices exist that make it possible to dispense different liquids packaged in a single unit comprising a plurality of independent reservoirs, but each liquid is dispensed separately by pressing on a button that is specific to it and that can act on the corresponding head.

Those devices are thus not ergonomic, and they do not offer the possibility of dispensing the liquids in isolation or simultaneously by means of a single push-button.

In addition, such devices do not make it possible to program various dispensing modes.

An object of the present invention is to solve those technical problems satisfactorily.

The invention achieves this object by means of a device of the preceding type, characterized in that it comprises a single push-button whose bottom face is provided with a series of axial bushes suitable for engaging simultaneously and removably over one or more dispensing heads by means of said push-button being turned and angularly keyed on a central bearing secured to the reservoirs.

In a particular embodiment, the bottom face of said push-button carries a central shaft suitable for being engaged rotatably in said bearing and whose free end projects beyond the bearing by being provided with angular keying lugs serving to co-operate with complementary retaining members provided on said bearing.

In a specific variant, said shaft is received at the center of a helical spring disposed between the bottom face of the push-button and said bearing so as to avoid any interference with the dispensing heads while the push-button is turning.

Preferably, the central shaft is provided with a frustoconical element whose large diameter is greater than the diameter of the shaft, thereby defining a peripheral shoulder on which the keying lugs are disposed.

In addition, said frustoconical element is split axially to enable it to be elastically compressed and to pass into said bearing.

According to an advantageous characteristic, the bearing is provided with fingers forming abutments for at least one positioning rib extending from the bottom face of the push-button.

In a variant, said rib adjoins the central shaft.

According to another characteristic, said bearing is fixed inside a cover mounted on the reservoirs and whose top face is flush with the top face of the push-button.

Preferably, the top face of the push-button is provided with an indexing element serving, by means of said push-button turning, to coincide with position marks provided on the top face of the cover.

According to yet another characteristic, the push-button is provided with a series of four bushes, two of which correspond respectively to a first head and to a second head being activated in isolation, while the other two bushes correspond to both heads being activated simultaneously.

The device of the invention makes it possible, with a single push-button, both to program the dispensing mode, and to actuate and implement the dispensing.

The device is applicable to a dispenser unit containing two or more liquids.

The structure of the device is particularly simple, easy to make, and thus inexpensive.

The device can be integrated very well technically and aesthetically into the various types of packaging.

The invention will be better understood on reading the following description given with reference to the drawings, in which.

Figure 1:
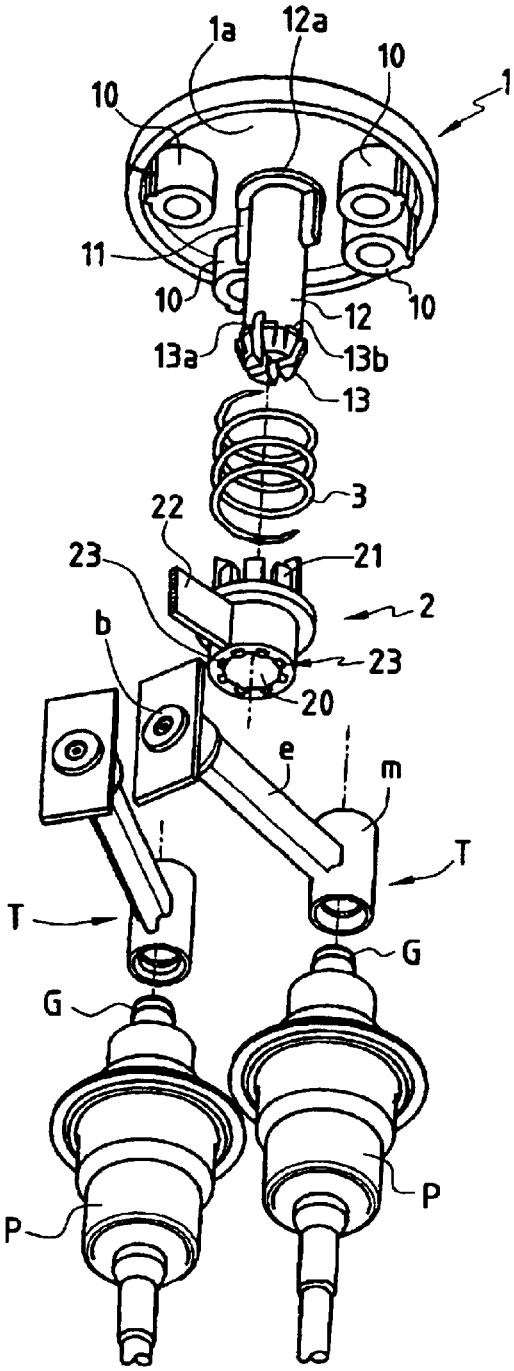
FIG. 1 is an exploded perspective view of an embodiment of the device of the invention.
Figure 2:
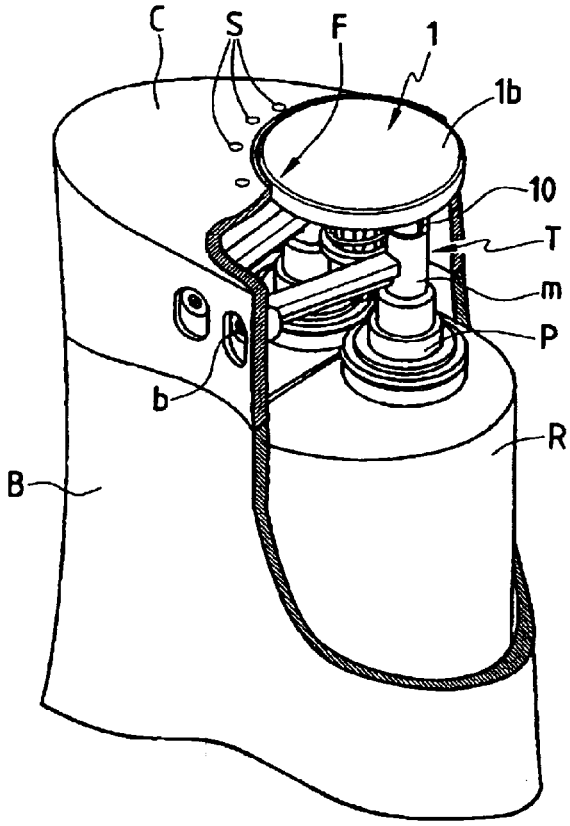
FIG. 2 is a cutaway perspective view of the device of the invention as integrated into a packaging unit.

The device of the invention shown in FIGS. 1 and 2 is designed for selectively dispensing liquids (such as medication, perfumes, cosmetics, etc.) from a plurality of independent reservoirs R (two reservoirs in this example). Each reservoir contains a different liquid which may or must be dispensed separately from or else simultaneously with the other liquids, for various reasons (olfactory, biochemical, medical, or other reasons).

Each of the reservoirs R is equipped with a drawing-off member for drawing off the liquid, which member is a precompression pump P in this example, provided with a spray tube G to which a spray head T is fitted.

In this example, the head is constituted by a sleeve m axially extending the tube G and defining an internal duct for removing the liquid, which duct communicates laterally with an end-piece e opening out towards the outside via a spray nozzle b.

In this example, the spray heads T are enclosed in a cover C extending a housing B in which the reservoirs R and the pumps P are housed.

Pressing on the head T in alignment with the pump P causes the tube G to be pushed in resiliently, and causes a metered quantity or "dose" of liquid to be discharged.

The device of the invention comprises a single push-button 1 whose bottom face 1*a* is provided with a series of axial bushes 10 and whose top face 1*b* is flush with the top face of the cover C, as shown in FIG. 2.

The bushes 10 are adapted and designed to engage over the dispensing heads T by turning and then angularly keying and pressing on the push-button in positions in which the bushes corresponding to the desired dispensing mode are aligned with the heads T.

To this end, the dimensions and in particular the diameter of the bushes 10 are determined as a function of the dimensions of the sleeves m so as to enable them to be connected temporarily in snugly-fitting and removable manner, enabling the pressing forces to be transmitted satisfactorily.

The device further comprises a bearing 2 which is disposed centrally along the axis of the push-button 1, and which is secured to the reservoirs R directly or indirectly via a link arm 22 attached to the cover C or to the housing B.

The bearing 2 receives a central shaft 12 carried by the bottom face 1*a* of the push-button 1 and extending along its axis.

The shaft 12 serves to be rotatably engaged in the bore 20 of the bearing 2, its free end projecting from the bore.

The end of the shaft 12 is provided with a frustoconical element 13 whose large diameter is greater than the diameter of the shaft 12, thereby defining a peripheral shoulder 13*a* on which angular keying lugs 13*b* are disposed.

The angular keying lugs 13*b* co-operate with complementary retaining members in the form of teeth 23 provided on the bottom edge of the bearing 2 whose outside diameter is substantially equal to the diameter of the shoulder 13*a*. The frustoconical element 13 is split axially, preferably in a cross-head configuration to enable it to be elastically compressed to pass into the bore 20 of the bearing 2 whose diameter is slightly greater than the diameter of the shaft 12.

The shaft 12 is received at the center of a helical spring 3 disposed between the bearing and the bottom face 1*a* of the push-button, against which face an end turn of the spring bears.

To this end, the bottom face 1*a* is provided with a circular base 12*a* that is coaxial with the shaft 12 and whose dimensions match the dimensions of the spring 3 so as to hold said spring. The spring 3 guarantees the presence of clearance between the bushes 10 and the heads T while the push-button 1 is being turned, so as to avoid any unwanted jamming.

The top face of the bearing 2 is provided with fingers 21 forming abutments for stopping the turning of the button 1 by co-operating with at least one positioning rib 11 (two diametrically opposite side ribs in this example that adjoin the shaft 12 and that extend from the bottom face of the push-button 1 or from the base 12*a*).

The ribs 11 are in lateral contact with the turns of the spring 3.

FIGS. 3A to 3D show various operating positions and configurations for the device of the invention, with a dispensing unit for dispensing two liquids I, II.

The push-button 1 performs two functions.

The first function of the push-button 1 consists in selecting a dispensing mode from among the three possible modes or the rest mode, by turning the button about its axis until an indexing element such as an arrow F carried by the top face 1*b* is caused to come into register with one of the marks S provided on the top face of the cover C.

Such turning is made possible by means of the presence of the spring 3, in spite of the ribs 11 interacting with the fingers 11, and of the lugs 13*b* interacting with the teeth 23.

Once it is positioned in the chosen configuration, the button 1 is keyed angularly, which guarantees that the dispensing heads T are aligned correctly with the bushes corresponding to the selected mode.

The push-button can then perform its second function which, by means of its top face 1*b* being pressed by hand, makes it possible to actuate the one or more pumps P via the dispensing heads T and the corresponding bushes 10.

Figures 3A, 3B, 3C, 3D:
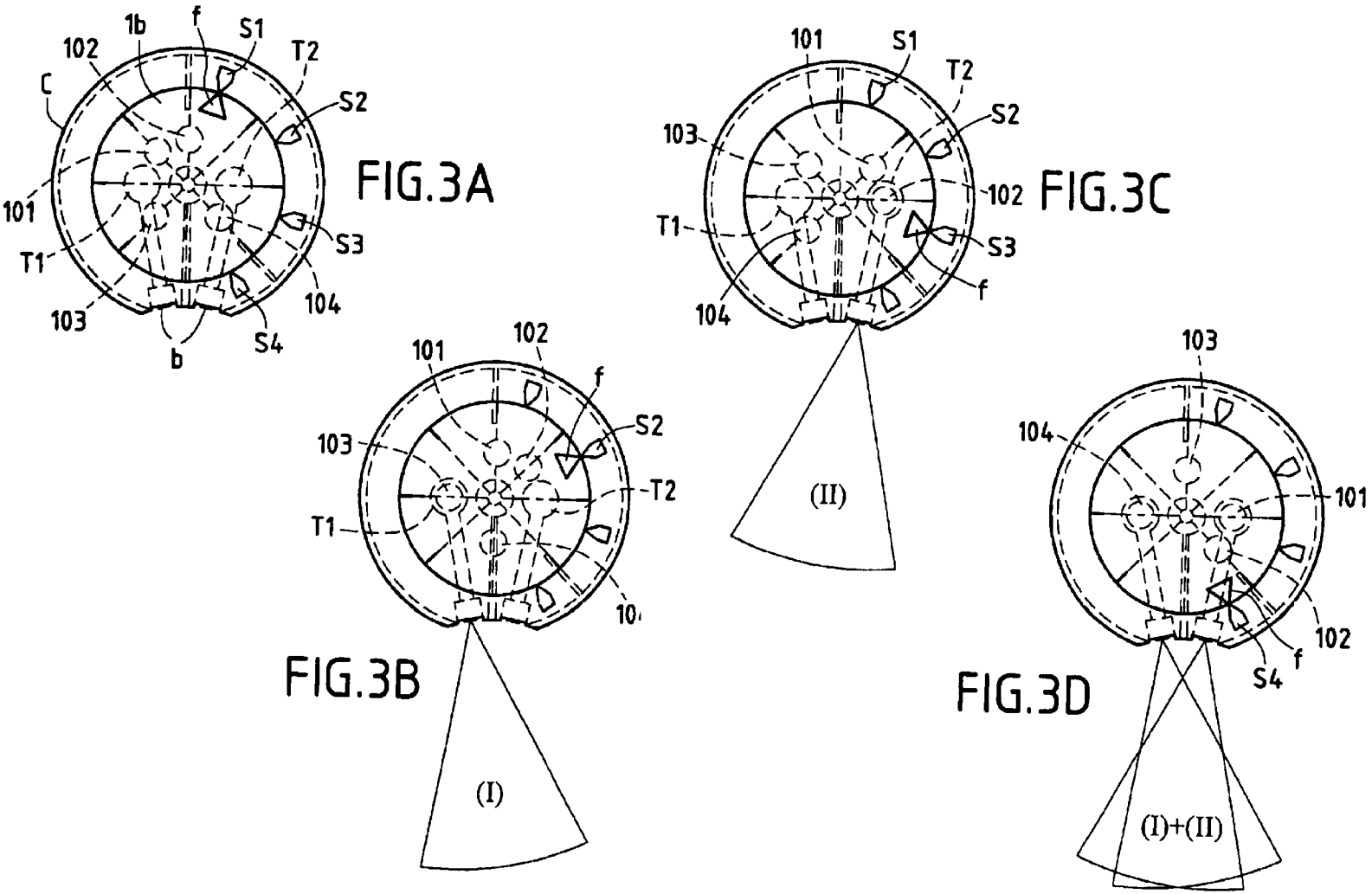
FIGS. 3A to 3D are diagrammatic plan views of the device of the preceding figures, in the various operating configurations.

In the configuration of FIG. 3A, the arrow F of the push-button 1 is angularly positioned facing the mark S1.

This position corresponds to a rest position because of the angular offset of all of the bushes 101 to 104 relative to the heads T1 and T2. Pushing in the push-button 1 thus causes the bushes to descend into empty space, without the heads T1, T2 being activated.

The push-button 1 being turned clockwise from the position of FIG. 3A causes the arrow F to coincide with the mark S2 as shown in FIG. 3B.

This position corresponds to the bush 103 being aligned with one of the heads T, namely the head T1 in this example.

The button 1 being pressed manually thus causes a single liquid (I) to be discharged.

The position shown in FIG. 3C corresponds to the mark S3 and guarantees that the bush 102 is aligned with the head T2. Pressing the button 1 thus makes it possible to dispense a single liquid (II).

The position shown in FIG. 3D corresponds to the mark S4.

In this position, the bushes 104 and 101 are aligned with respective ones of the two heads T1 and T2.

Pressing on the button 1 makes it possible to activate the two pumps jointly and to dispense the liquids (I) and (II) simultaneously.

Naturally, the relative positions of the bushes 101 to 104 firstly between themselves on the button 1, and secondly relative to the positions of the heads are determined as of designing of the device.

The embodiment of the device shown herein is adapted to two liquids, but other embodiments may equally apply to more than two liquids, by increasing the number of bushes and by adjusting their respective positions.

What is claimed is:

1. A device for selectively dispensing liquids from a plurality of independent reservoirs (R), each of which is equipped with a drawing-off member (P) provided with a dispensing head (T) suitable for being actuated by being pressed axially, said device comprising a single push-button (1) having a bottom face (1*a*) provided with a series of axial bushes (10) arranged for engaging selectively over one or more dispensing heads (T) by means of said push-button (1) upon said push button being turned and angularly keyed on a central bearing (2) secured to the reservoirs (R).

2. The device according to claim 1, wherein the bottom face (1*a*) of said push-button (1) carries a central shaft (12) rotatably engageable in said bearing (2) and having a free end that projects beyond the bearing by being provided with angular keying lugs (13*b*) serving to co-operate with complementary retaining members provided on said bearing (2).

3. The device according to claim 2, wherein said shaft (12) is received at the center of a helical spring (3) disposed between the bottom face (1*a*) of the push-button (1) and said bearing (2) so as to avoid any interference with the dispensing heads while the push-button is turning.

4. The device according to claim 3, wherein the free end of the central shaft (12) is provided with a frustoconical element (13) whose large diameter is greater than the diameter of the shaft (12), thereby defining a peripheral shoulder (13*a*) on which the keying lugs (13*b*) are disposed.

5. The device according to claim 4, wherein said frustoconical element (13) is split axially to enable it to be elastically compressed and to pass into said bearing (2).

6. The device according to claim 1, wherein said bearing (2) is provided with fingers (21) forming abutments for at least one positioning rib (11) extending from the bottom face (1*a*) of the push-button (1).

7. The device according to claim 6, wherein said rib (11) adjoins the central shaft (12).

* * * * *